US009396838B2

(12) United States Patent
Kummer et al.

(10) Patent No.: US 9,396,838 B2
(45) **Date of Patent: *Jul. 19, 2016**

(54) ARMORED CABLE WITH INTEGRAL SUPPORT

(71) Applicant: Southwire Company, LLC, Carrollton, GA (US)

(72) Inventors: Randy D. Kummer, Villa Rica, GA (US); Richard M. Temblador, Carrollton, GA (US); David Mercier, Carrollton, GA (US); John Armstrong, Carrollton, GA (US); Paul H. White, Carrollon, GA (US)

(73) Assignee: Southwire Company, LLC, Carrollton, GA (US)

( * ) Notice: Subject to any disclaimer, the term of this patent is extended or adjusted under 35 U.S.C. 154(b) by 2 days.

This patent is subject to a terminal disclaimer.

(21) Appl. No.: 14/187,596

(22) Filed: Feb. 24, 2014

(65) Prior Publication Data

US 2014/0166336 A1 Jun. 19, 2014

Related U.S. Application Data

(63) Continuation of application No. 12/814,595, filed on Jun. 14, 2010, now Pat. No. 8,697,996, which is a continuation of application No. 12/046,488, filed on Mar. 12, 2008, now Pat. No. 7,754,969.

(60) Provisional application No. 60/942,727, filed on Jun. 8, 2007.

(51) Int. Cl.
*H01B 11/18* (2006.01)
*H01B 7/00* (2006.01)
(Continued)

(52) U.S. Cl.
CPC ..... *H01B 7/0009* (2013.01); *H01B 7/184* (2013.01); *H01B 9/028* (2013.01); *H01B 7/04* (2013.01); *H01B 7/1895* (2013.01)

(58) Field of Classification Search
CPC ... H01B 11/183; H01B 11/1834; H01B 9/023
USPC ..... 174/102 D, 116, 113 R
See application file for complete search history.

(56) References Cited

U.S. PATENT DOCUMENTS 1,687,013 A 10/1928 Frederickson
1,788,483 A 1/1931 Frederickson
(Continued)

FOREIGN PATENT DOCUMENTS

CA 525826 6/1956
CN 2067451 U 12/1990
(Continued)

OTHER PUBLICATIONS

Carmin J. Scotti, Literature Search Report, Dec. 19, 2005, 38 pgs.
(Continued)

*Primary Examiner* — Chau N Nguyen
(74) *Attorney, Agent, or Firm* — Merchant & Gould P.C.

(57) ABSTRACT

A system for providing cable support may be provided. The system may comprise a conductor core, a filler that may provide integral core support, and armor. The conductor core may comprise at least one conductor. The filler may be applied around at least a portion of the conductor core. The armor may be applied around at least a portion of the filler. The applied armor may be configured to cause the filler to apply a strong enough force on an exterior of the conductor core configured to keep the conductor core from slipping down an interior of the filler due to a gravitational force. In addition, the applied armor may be configured to cause the filler to apply a strong enough force on an interior of the armor configured to keep a combination of the conductor core and the filler from slipping down the interior of the armor due to the gravitational force.

20 Claims, 5 Drawing Sheets

(51) Int. Cl.

| | |
|---|---|
| ***H01B 7/18*** | (2006.01) |
| ***H01B 9/02*** | (2006.01) |
| *H01B 7/04* | (2006.01) |

(56) References Cited

U.S. PATENT DOCUMENTS

| | | | | |
|---|---|---|---|---|
| 1,995,407 | A | 3/1935 | Walker | |
| 2,258,687 | A | 10/1941 | Peterson | |
| 2,308,274 | A | 1/1943 | Frederickson | |
| 2,866,843 | A | 12/1958 | Arman | |
| 3,023,267 | A | 2/1962 | Rubinstein et al. | |
| 3,032,604 | A | 5/1962 | Timmons | |
| 3,600,500 | A | 8/1971 | Schoemer et al. | |
| 3,660,592 | A | 5/1972 | Anderson | |
| 3,673,315 | A | 6/1972 | Lasley | |
| 3,829,603 | A | 8/1974 | Hansen et al. | |
| 4,081,602 | A | 3/1978 | Paniri et al. | |
| RE30,194 | E | 1/1980 | Bruno et al. | |
| 4,273,806 | A * | 6/1981 | Stechler | 427/119 |
| 4,368,350 | A | 1/1983 | Perelman | |
| 4,368,613 | A | 1/1983 | Sanchez | |
| 4,374,299 | A | 2/1983 | Kincaid | |
| 4,510,346 | A | 4/1985 | Bursch, Jr. et al. | |
| 4,956,523 | A | 9/1990 | Pawluk | |
| 5,191,173 | A | 3/1993 | Sizer et al. | |
| 5,192,834 | A | 3/1993 | Yamanishi et al. | |
| 5,212,350 | A | 5/1993 | Gebs | |
| 5,218,167 | A | 6/1993 | Gasque, Jr. | |
| 5,329,065 | A | 7/1994 | Marney et al. | |
| 5,350,885 | A | 9/1994 | Falciglia et al. | |
| 5,416,268 | A | 5/1995 | Ellis | |
| 5,672,640 | A | 9/1997 | Brauer | |
| 5,939,668 | A | 8/1999 | De Win | |
| 6,259,019 | B1 | 7/2001 | Damilo et al. | |
| 6,310,295 | B1 | 10/2001 | Despard | |
| 6,486,395 | B1 | 11/2002 | Temblador | |
| 6,491,067 | B1 * | 12/2002 | Davenport et al. | 138/110 |
| 6,566,606 | B1 | 5/2003 | Hazy et al. | |
| 6,624,358 | B2 | 9/2003 | Krabec et al. | |
| 6,906,264 | B1 | 6/2005 | Grant, Jr. et al. | |
| 7,166,802 | B2 | 1/2007 | Cusson et al. | |
| 7,309,835 | B2 | 12/2007 | Morrison et al. | |
| 7,432,446 | B2 | 10/2008 | Orfin et al. | |
| 7,469,470 | B2 | 12/2008 | Cusson et al. | |
| 7,754,969 | B2 | 7/2010 | Kummer et al. | |
| 7,880,089 | B1 | 2/2011 | Herrin | |
| 8,664,532 | B1 | 3/2014 | Herrin | |
| 8,697,996 | B2 | 4/2014 | Kummer et al. | |
| 2008/0302554 | A1 | 12/2008 | Kummer et al. | |
| 2010/0252299 | A1 | 10/2010 | Kummer et al. | |

FOREIGN PATENT DOCUMENTS

| | | | |
|---|---|---|---|
| CN | 2181733 | Y | 11/1994 |
| CN | 1195359 | A | 10/1998 |
| CN | 2559079 | Y | 7/2003 |
| CN | 2632818 | Y | 8/2004 |
| CN | 1588564 | A | 3/2005 |
| DE | 1 075 181 | | 2/1960 |
| DE | 197 19 410 | A1 | 11/1997 |
| EP | 0382557 | | 9/1990 |
| FR | 2 762 438 | | 10/1998 |
| GB | 351881 | | 7/1931 |
| JP | 54-14138 | | 2/1979 |
| JP | 5-28845 | | 2/1993 |
| JP | 6-96618 | | 4/1994 |
| JP | 11-232934 | | 8/1999 |

OTHER PUBLICATIONS

David Johnson, Search Report, Apr. 13, 2005, 12 pgs.
International Search Report dated Sep. 10, 2008 cited in Application No. PCT/US2008/063846.
Underwriters Laboratories Inc., UL4, Standard for Safety, Armored Cable, Nov. 4, 1998, 35 pgs.
Underwriters Laboratories Inc., UL 1569, Metal-Clad Cables, May 25, 2005, 58 pgs.
National Fire Protection Association, NFPA 70 National Electrical Code, 1999 Edition, Article 100, 250, 333, 334, 517, 65 pgs.
Underwriters Laboratories Inc., UL 1569, Metal-Clad Cables, Oct. 10, 2005, 70 pgs.
Powers, Jr., The Basics of Power Cable, Cement Industry Technical Conference, 1994, XXXVI Conference Record, $36_{th}$ IEEE, pp. 37-45, (May 29-Jun. 2, 1994).
Hartwell, Abstract: Wiring Methods for Patient Care Areas, EC & M: Electrical Construction and Maintenance, vol. 93(4), pp. 82-83, Elsevier, Inc. (2008).
Jenks et al., Performance of Bare Aluminum Wire as Armoring Material for Submarine Cables, IEEE Transactions on Power Apparatus and Systems, vol. 82(66), pp. 379-382 (Jun. 1963).
Temblador, New Form of Type MC Cable Crosses Application Boundaries, IAEI News, pp. 83-89, Sep.-Oct. 2006.
Copending U.S. Appl. No. 12/985,875, filed Jan. 6, 2011 entitled "Metal-Clad Cable Assembly".
U.S. Official Action dated Oct. 13, 2009, in U.S. Appl. No. 12/139,249, filed on Jun. 13, 2008, 16 pages.
U.S. Official Action dated Mar. 27, 2013, in U.S. Appl. No. 12/985,875, 17 pages.
Mexican Office Action dated Nov. 5, 2010 cited in Application No. MX/a/2009/013141.
Mexican Second Office Action dated Jul. 8, 2011 cited in Application No. MX/a/2009/013141.
Mexican Third Office Action dated Feb. 3, 2012 cited in Application No. MX/a/2009/013141; 4 pages.
Chinese First Office Action dated Apr. 21, 2011 cited in Application No. 200880012907.2.
Translation of Chinese Second Office Action dated Apr. 19, 2012 cited in Application No. 200880012907.2; 6 pages.
Chinese Office Action dated Oct. 31, 2012 cited in Application No. 200880012907.2, 5 pages.
Chase Wire & Cable Materials Product Data Sheet. Chase & Sons C1033 Separator Tape; 1 page.
Chase Wire & Cable Materials Product Data Sheet. Chase & Sons C1024 Separator Tape; 1 page.

* cited by examiner

ARMORED CABLE WITH INTEGRAL SUPPORT

REFERENCE TO RELATED APPLICATIONS

This application is a continuation application of U.S. patent application Ser. No. 12/814,595, filed on Jun. 14, 2010, now U.S. Pat. No. 8,697,996, which is a continuation application of U.S. patent application Ser. No. 12/046,488, filed on Mar. 12, 2008, now U.S. Pat. No. 7,754,969, which claims the benefit of U.S. Provisional Application No. 60/942,727, filed on Jun. 8, 2007, the disclosures of which are incorporated herein by reference in their entirety.

BACKGROUND

Cable risers are used to supply power, for example, to multi-story building such as apartments or condominiums. For example, conductors may be placed in a vertical raceway and run to individual apartments. In some situations, due to gravitational forces, conductors within the vertical raceways may slip down the armor. For example, to stop this cable slippage, offsets may be used. Thus, the conventional strategy is to create horizontal offsets in the vertical raceway runs to stop slippage. This often causes problems because conventional systems create significant costs and time requirements for installing cable risers. In view of the foregoing, there is a need for methods and systems for providing vertical cable and raceways more optimally. Furthermore, there is a need for providing cable raceways with integral (i.e. built-in) support.

SUMMARY

A system for providing cable support may be provided. The system may comprise a conductor core, a filler that may provide integral core support, and armor. The conductor core may comprise at least one conductor. The filler may be applied around at least a portion of the conductor core. The armor may be applied around at least a portion of the filler. The filler may apply a strong enough force on an exterior of the conductor core configured to keep the conductor core from slipping down an interior of the filler due to a gravitational force. In addition, the filler may apply a strong enough force on an interior of the armor configured to keep a combination of the conductor core and the filler from slipping down the interior of the armor due to the gravitational force.

It is to be understood that both the foregoing general description and the following detailed description are examples and explanatory only, and should not be considered to restrict the invention's scope, as described and claimed. Further, features and/or variations may be provided in addition to those set forth herein. For example, embodiments of the invention may be directed to various combinations and sub-combinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
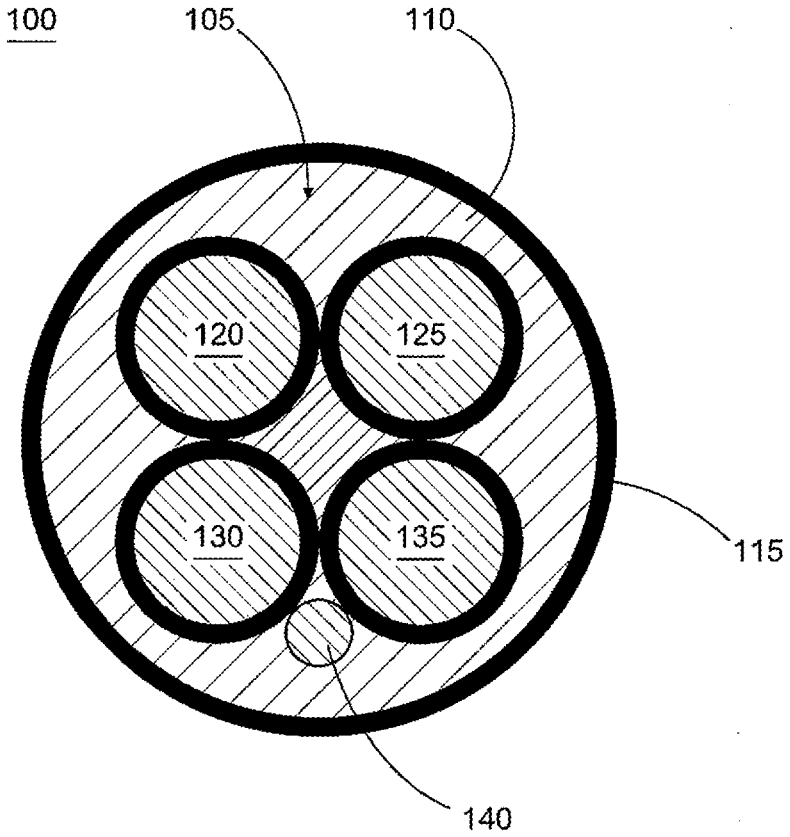
FIG. 1 is a diagram of an armored cable system with integral support.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Consistent with embodiments of the invention, an armored cable with integral support may be provided. Embodiments of the invention may eliminate conventional cable offsets in vertical raceway cable installations by providing integral support between conductors and the armor. Consequently, the integral support may keep the conductors within the armor in a vertical raceway installation from slipping down due to gravitational forces. Accordingly, embodiments of the invention may reduce cable installation time and cost.

FIG. 1 shows a diagram of an armored cable system 100 with integral support. FIG. 1 shows a cross-section of system 100, which may have a longitudinal length. As shown in FIG. 1, system 100 may include a conductor core 105, a filler 110, and an armor 115. Conductor core 105, though not so limited, may comprise a first conductor 120, a second conductor 125, a third conductor 130, a fourth conductor 135, and a ground wire 140. Fourth conductor 135 may be configured to be used as a neutral (e.g. may have an insulation color designating it as a neutral or may be of a different size than the other conductors in conductor core 105).

While as shown in FIG. 1, conductor core 105 includes four conductors and a neutral, embodiments of the invention are not so limited. For example, conductor core 105 may include any number of conductors (e.g. insulated, non-insulated, or otherwise) and may include any number of ground wires or may not include a ground wire. Any one or more of the conductors in conductor core 105 may be configured to be a neutral wire, or none of the conductors in conductor core 105 may be configured to be a neutral wire. Any one or more of the conductors or ground wire(s) in conductor core 105 may have an insulation color indicating that any one or more of the conductors or ground wire(s) in conductor core 105 is intended as a neutral(s). Furthermore, the conductors or ground wire(s) in conductor core 105 may all be the same size or they may vary individually or in any sub-combination by size. In addition, the conductors or ground wire(s) in conductor core 105 may all be made of the same material (e.g. copper, aluminum, etc.) or they may vary individually or in any sub-combination by material. Also, the conductors or ground wire(s) in conductor core 105 may all be stranded or solid or they may vary individually or in any sub-combination by being stranded or solid. Notwithstanding, conductor core 105 may comprise any conductor construction.

Filler 110 may comprise, but is not limited to, polyethylene, polyvinyl chloride (PVC), or nylon. A foaming agent, a material comprising micro-spheres, or other similar substances may be added to filler 110 before filler 110 is extruded onto conductor core 105. The foaming agent may be configured to create voids in filler 110. When filler 110 is compressed in a first direction (e.g. toward the center of system 100,) the voids (or micro-spheres) in filler 110 may tend to create an opposing force in filler 110 opposite the first direction. For example, after being extruded onto conductor core 105, filler 110 may have a "squeezing" force applied to its exterior by armor 115. With this squeezing force applied to filler 110, the voids (or micro-spheres) in filler 110 may be configured to cause filler 110 to: i) apply a strong enough force on the exterior of conductor core 105 to keep conductor core 105 from slipping down filler 110's interior due to gravitational forces on conductor core 105; and ii) apply a strong enough force on armor 115's interior to keep the combination of conductor core 105 and filler 110 from slipping down armor 115's interior due to the gravitational forces on conductor core 105 and filler 110. As stated above, micro-spheres added to the filler 110 may cause an effect similar to the voids created by the foaming agent. The micro-spheres may tend to be more evenly distributed in filler 110 than the voids.

Filler 110 may comprise, but is not limited to, a flexible PVC compound (e.g. SW1005) with 0.1% to 5% HC-01 foaming agent by weight. The foaming agent may be supplied by Bayer Corporation of 100 Bayer Road, Pittsburgh, Pa. 15205-9741. Furthermore, as stated above, micro-spheres may be combined with the flexible PVC compound instead of the foaming agent for example. The micro-spheres may comprise Expancel micro-spheres 930 MB 120 supplied by Expancel-AKZO NOBEL of 2240 Northmont Parkway, Duluth, Ga. 30096. The formulation using micro-spheres may comprise 0.5% 930 MB 120 to 99.5% SW1005 by weight. The range of Expancel micro-spheres used may vary, for example, between 0.1% and 5% by weight.

Notwithstanding, filler 110 may comprise or be augmented with any substance that (when filler 110 is squeezed) is, for example, capable of: i) applying a strong enough force on the exterior of conductor core 105 to keep conductor core 105 from sliding down filler 110's interior due to gravitational forces on conductor core 105; and ii) applying a strong enough force on the interior of armor 115 to keep the combination of conductor core 105 and filler 110 from slipping down armor 115's interior due to gravitational forces on conductor core 105 and filler 110.

Armor 115 may comprise any substance (e.g. metallic, non-metallic, electrically conductive, electrically semi-conductive, etc.) or construction capable of creating the aforementioned "squeezing" force applied to filler 110's exterior. For example, armor 115 may comprise a continuous strip having a width and being applied helically around filler 110. The continuous strip, for example, may be snuggly or tightly wrapped around filler 110. The continuous strip (e.g. metallic or non-metallic) may have a concave side facing filler 110. Concavities in the concave side may tend to be filled by portions of filler 110 when armor 115 squeezes filler 110. This concavity filling may aid filler 110 in applying the aforementioned force strong enough on the interior of the armor 115 to keep the combination of conductor core 105 and filler 110 from slipping down armor 115's interior due to gravitational forces on conductor core 105 and filler 110. Armor 115 may be, but is not limited to, welded corrugations or other assembly construction such as interlocked strip or braided stranding for example.

Consistent with embodiments of the invention, armored cable system 100 may be used in cable risers used to supply power, for example, to multi-story building such as apartments or condominiums. For example, armored cable system 100 may be placed in a substantially vertical raceway and run to individual apartments. Due to gravitational forces, conventional conductors within the vertical raceways may slip down the armor. However, consistent with embodiments of the invention, gravitational forces may not cause conductor core 105 to slip down armor 115 because armored cable system 100 may include integral support. This may be true even when armored cable system 100 (and thus conductor core 105) is in a substantial vertical altitude or position. This integral support may be created by filler 110 being "squeezed" by armor 115. With this squeezing force applied to filler 110, voids or micro-spheres in filler 110 may be configured to cause filler 110 to: i) apply a strong enough force on the exterior of conductor core 105 to keep conductor core 105 from slipping down filler 110's interior due to gravitational forces on conductor core 105; and ii) apply a strong enough force on armor 115's interior to keep the combination of conductor core 105 and filler 110 from slipping down armor 115's interior due to gravitational forces on conductor core 105 and filler 110.

Figure 2:
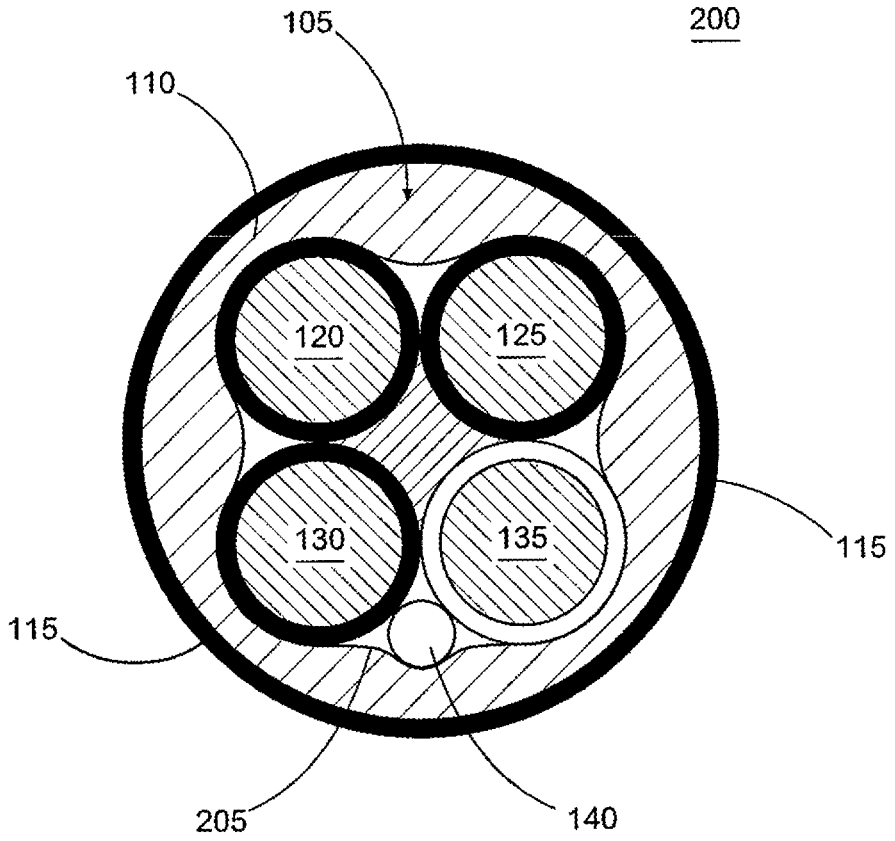
FIG. 2 is a diagram of an armored cable system with integral support and tape separator.
Figure 3:
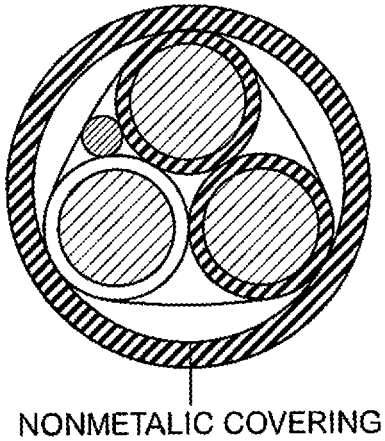
FIG. 3 is a diagram of an armored cable system using different fillers and rubber cord configurations.
Figure 4:
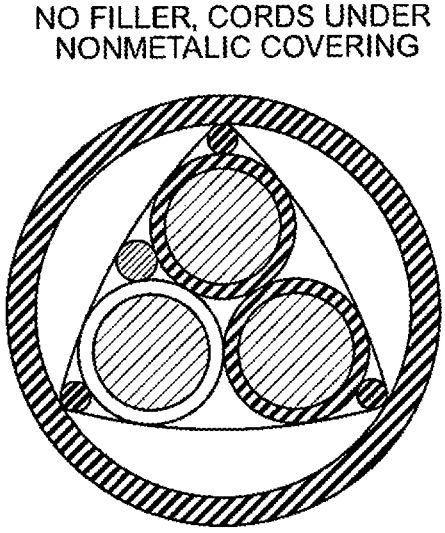
FIG. 4 is a diagram of an armored cable system using different fillers and rubber cord configurations.
Figure 5:
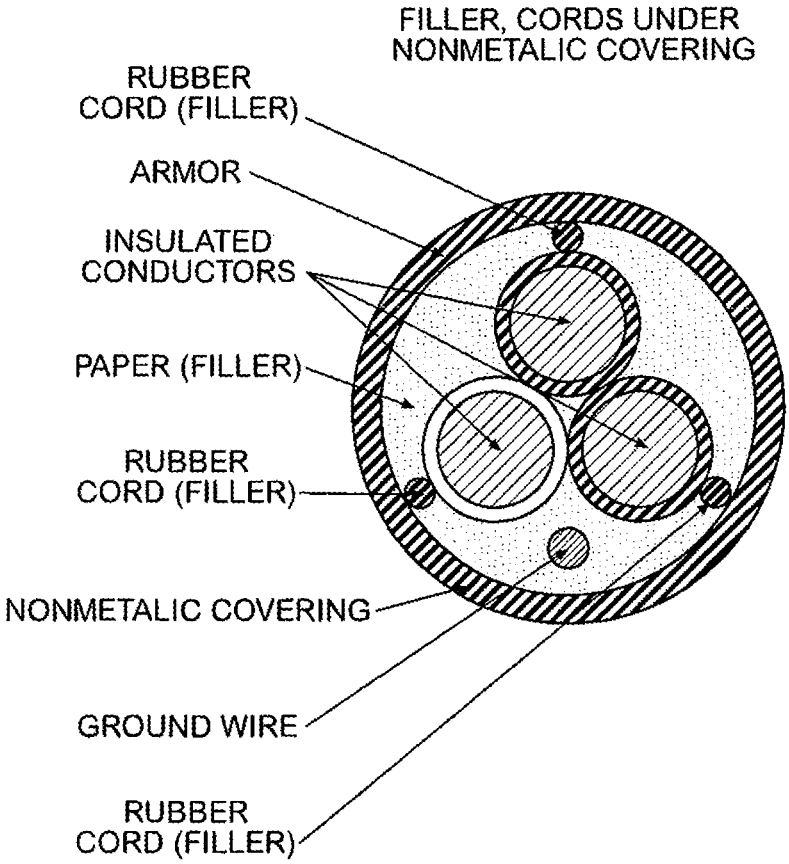
FIG. 5 is a diagram of an armored cable system using different fillers and rubber cord configurations.

FIG. 2 shows a diagram of a cable system 200 with integral support and tape separator. As shown in FIG. 2, system 200 may include the same elements of system 100 as described above; however, system 200 may include the addition of a tape separator 205. Tape separator 205 may be non-metallic. Notwithstanding tape separator 205, system 200 may be constructed and may function in ways similar to system 100. FIGS. 3 through 5 show other embodiments using different fillers and rubber cord configurations.

Figure 6:
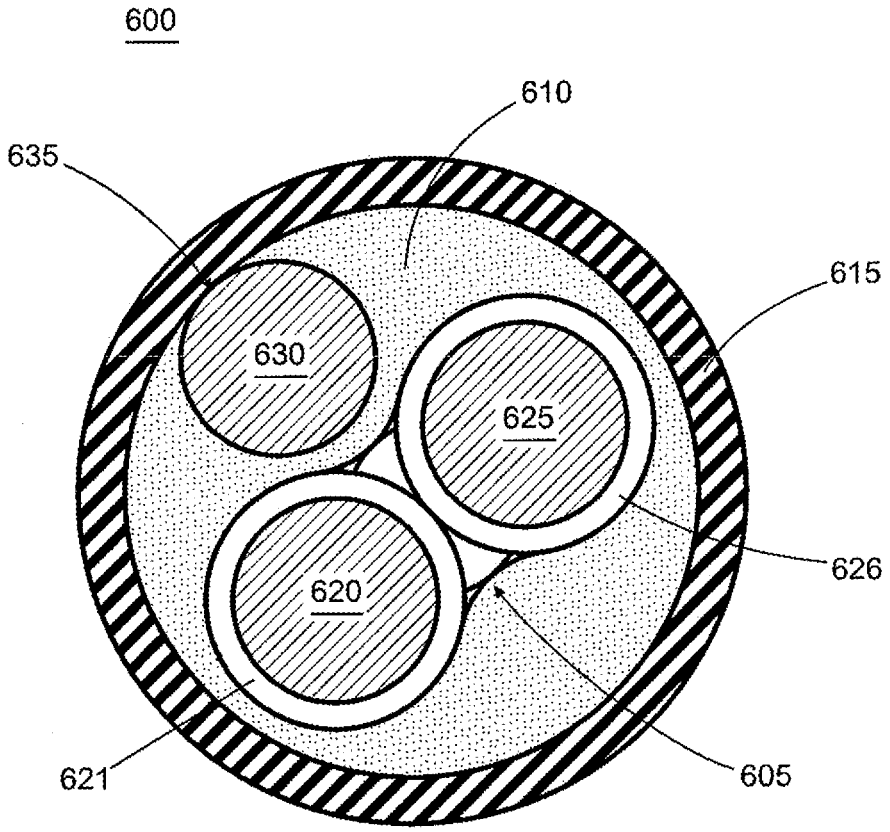
FIG. 6 is a diagram of an armored cable system with grounded armor.

FIG. 6 shows a diagram of an armored cable system 600 with grounded armor consistent with embodiments of the invention. System 600 may be used, for example, in applications where electrical codes may require a cable's armor to be well grounded such as in a medical or critical care environment. As shown in FIG. 6, system 600 may include a conductor core 605, a filler 610, an armor 615, and a ground wire 630. FIG. 6 shows a cross-section of system 600, which may have a longitudinal length. For example, ground wire 630 may be placed between filler 610 and armor 615 where ground wire 630 and armor 615 come into electrical contact at a point 635, for example, as described in more detail below.

Conductor core 605, though not so limited, may comprise a first conductor 620 and a second conductor 625. First conductor 620 and second conductor 625 may respectively include insulation layer 621 and insulation layer 626. Notwithstanding, conductor core 605 may include more or less conductors compared to the example shown in FIG. 6. In addition, system 600 may include more or less ground wires compared to the example shown in FIG. 6. Conductor core 605 may be of similar construction as conductor code 105 as described above. However, conductor core 605 may or may not include a ground wire or neutral wire. Similarly, conductor 620 and conductor 625 may be of the same construction as conductor 120 and conductor 125 respectively as described above and ground wire 630 may be of the same construction as ground wire 140 as described above. Moreover, filler 610 and armor 615 may be of similar construction to filler 110 and armor 115 respectively as described above.

Armor 615 may comprise any substance (e.g. metallic, non-metallic, electrically conductive, electrically semi-conductive, etc.) or construction capable of creating a "squeezing" force applied to filler 610's exterior. For example, armor 615 may comprise a continuous strip having a width and being applied helically around filler 610. The continuous strip, for example, may be snuggly or tightly wrapped around filler 610. The continuous strip may have a concave side facing filler 610. Concavities in the concave side facing filler 610 may tend to be filled by portions of filler 610 when armor 615 squeezes filler 610. As described in more detail below, when the aforementioned squeezing force is applied to filler 610 by armor 615, voids (or micro-spheres) in filler 610 may cause filler 610 to apply a strong enough force to ground wire 630 to create an electrical connection between ground wire 630 and armor 615 at point 635, for example.

As described above with respect to FIG. 6, filler 610 may comprise, but is not limited to, polyethylene, polyvinyl chloride (PVC), or nylon. A foaming agent or a material comprising micro-spheres may be added to filler 610 before filler 610 is extruded onto conductor core 605. (Examples of the types and amounts of foaming agent and micro-spheres are described above with respect to filler 110.) The foaming agent may be configured to create voids in filler 610. Notwithstanding, filler 610 may comprise or be augmented with any substance that may be capable of causing filler 610 to apply a strong enough force to ground wire 630 to create an electrical connection between ground wire 630 and armor 615.

Consistent with embodiments of the invention, when filler 610 is compressed (e.g. squeezed by armor 615 or otherwise compressed within armor 615) in a first direction (e.g. toward the center of system 600,) the voids (or micro-spheres) in filler 610 may tend to create an opposing force in filler 610 opposite the first direction. For example, after being extruded onto conductor core 605, filler 610 may have a squeezing force applied to its exterior by armor 615. With this squeezing force applied to filler 610 (e.g. toward the center of system 600,) the voids (or micro-spheres) in filler 610 may tend to create an opposing force in filler 610 opposite the first direction. Consequently, this opposing force may cause filler 610 to apply a strong enough force to ground wire 630 to create an electrical connection between ground wire 630 and armor 615. In other words, armor 615 may press against ground wire 630 on one side of ground wire 630 and filler 610 may press against ground wire 630 on a side opposing armor 615. Accordingly, ground wire 630 may snuggly contact armor 615 at at least point 635. Moreover, ground wire 630 may snuggly contact armor 615 at any number of points along system 600's longitudinal length and is not limited to contacting armor 615 at only point 635. In addition, ground wire 630 may contact armor 615 continuously along system 600's longitudinal length. When ground wire 630 and armor 615 are both electrically conductive (e.g. both being bare and metallic,) the aforementioned contact between ground wire 630 and armor 615 may create an electrical connection between ground wire 630 and armor 615.

Consistent with embodiments of the invention, filler 110 or filler 610 may be applied to conductor core 105 or conductor core 605 respectively in any manner and there application is not limited to extrusion. Furthermore, forces caused by filler 110 or filler 610 are not limited to being created by applying armor 115 or armor 615 to squeeze filler 110 or filler 610 respectively. These forces created in filler 110 or filler 610 may be created in any way. In addition, filler 110 and filler 610 may respectively electrically insulate conductor core 105 and conductor core 605 from armor 115 and armor 615. Furthermore, the construction of system 100 or system 600 is not limited to any sequence and the elements that make up system 100 or system 600 can be applied in any sequence.

While certain embodiments of the invention have been described, other embodiments may exist. Further, the disclosed methods' stages may be modified in any manner, including by reordering stages and/or inserting or deleting stages, without departing from the invention.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A cable comprising:

a conductor core comprising at least three conductors and at least one ground wire, wherein the at least one ground wire is adjacent at least one of the at least three conductors;

a filler around the conductor core, the filler comprising micro-spheres and a polyvinyl chloride; and an electrically conductive armor around the filler, the armor comprising a concave side facing the filler, wherein portions of the filler fill concavities created by the concave side.

2. The cable of claim 1, wherein at least one of the at least three conductors is an insulated conductor.

3. The cable of claim 1, wherein the at least three conductors are insulated conductors.

4. The cable of claim 3, wherein the amount of micro-spheres is between 0.1% and 5% based on the total weight of the filler.

5. The cable of claim 1, wherein the armor is free of a jacket on an exterior of the armor.

6. The cable of claim 1, wherein the armor comprises a continuous strip applied helically around the filler.

7. The cable of claim 1, wherein the armor comprises interlocked strips applied around the filler.

8. The cable of claim 1, wherein the armor is configured to cause the filler to:

apply a strong enough force on an exterior of the conductor core configured to keep the conductor core from slipping down an interior of the filler due to a gravitational force on the conductor core when the cable is in a substantial vertical altitude; and apply a strong enough force on an interior of the armor configured to keep a combination of the conductor core and the filler from slipping down the interior of the armor due to the gravitational force on the conductor core and a gravitational force on the filler.

9. A cable comprising:

a conductor core comprising two or more conductors and at least one ground wire, wherein the at least one ground wire is adjacent at least one of the two or more conductors;

a filler around the conductor core, the filler comprising micro-spheres and a polyethylene, a polyvinyl chloride, or a nylon; and an electrically conductive armor around the filler, the armor comprising a concave side facing the filler, wherein portions of the filler fill concavities created by the concave side.

10. The cable of claim 9, wherein the filler comprises micro-spheres and polyethylene.

11. The cable of claim 9, wherein the filler comprises micro-spheres and polyvinyl chloride.

12. The cable of claim 9, wherein the amount of micro-spheres is between 0.1% and 5% based on the total weight of the filler.

13. The cable of claim 9, wherein the armor is configured to cause the filler to:

apply a strong enough force on an exterior of the conductor core configured to keep the conductor core from slipping down an interior of the filler due to a gravitational force on the conductor core when the cable is in a substantial vertical altitude; and apply a strong enough force on an interior of the armor configured to keep a combination of the conductor core and the filler from slipping down the interior of the armor due to the gravitational force on the conductor core and a gravitational force on the filler.

14. The cable of claim 9, wherein the armor is free of a jacket on an exterior of the armor.

15. The cable of claim 9, wherein the armor comprises a continuous strip applied helically around the filler.

16. The cable of claim 9, wherein at least one of the conductors is an insulated conductor.

17. A cable comprising:

a conductor core comprising two or more conductors and at least one ground wire, wherein the at least one ground wire is adjacent at least one of the two or more conductors;

a filler around at least a portion of the conductor core, the filler comprising a foamed polyethylene, a foamed polyvinyl chloride, or a foamed nylon; and an electrically conductive armor around the filler, the armor comprising a concave side facing the filler, wherein portions of the filler fill concavities created by the concave side.

18. The cable of claim 17, wherein the filler comprises foamed polyvinyl chloride.

19. The cable of claim 17, wherein the armor is free of a jacket on an exterior of the armor.

20. The cable of claim 17, wherein at least one of the conductors is an insulated conductor.

* * * * *